United States Patent [19]

Johns et al.

[11] Patent Number: 4,944,495

[45] Date of Patent: Jul. 31, 1990

[54] METHOD AND APPARATUS FOR LEVELING A REFRACTORY BED SURFACE

[75] Inventors: Robert H. Johns, Natrona Heights; J. Richard Rzomp, Brackenridge, both of Pa.

[73] Assignee: Allegheny Ludlum Corporation, Pittsburgh, Pa.

[21] Appl. No.: 303,867

[22] Filed: Jan. 30, 1989

[51] Int. Cl.[5] ..... C21D 9/00

[52] U.S. Cl. ..... 266/100; 266/287

[58] Field of Search ..... 266/100, 287; 264/500, 264/503; 56/400.01, 400.02, 400.04, 400.05; 239/652; 33/365, 370; 7/163, 164; 104/10, 13; 425/170, 171, 169, 425, 426, 428, 431, 456, 457, 458

[56] References Cited

U.S. PATENT DOCUMENTS

| | | | |
|---|---|---|---|
| 31,113 | 11/1861 | Esterly | 56/400.01 |
| 2,787,203 | 4/1957 | Smith | 56/400.01 |
| 3,778,221 | 12/1973 | Bloom | 432/11 |
| 3,859,002 | 1/1975 | Sauey | 33/370 |

FOREIGN PATENT DOCUMENTS

| | | | |
|---|---|---|---|
| 0427972 | 5/1935 | United Kingdom | 56/400.01 |

*Primary Examiner*—S. Kastler

*Attorney, Agent, or Firm*—Patrick J. Viccaro

[57] ABSTRACT

A leveling apparatus for leveling a surface of refractory bed comprised of refractory pebbles. The leveling apparatus is comprised of a disk having a level bottom surface suitable for positioning upon the surface of the refractory bed. A plurality of spaced apart, downwardly extending tooth members project beneath the level, bottom surface of the disk, and into the refractory bed. Rotation of the disk causes the plurality of tooth members to displace the refractory pebbles in a rake-like manner to thereby level the surface of the refractory bed by causing the refractory pebbles to conform to the level bottom surface of the disk.

10 Claims, 2 Drawing Sheets

METHOD AND APPARATUS FOR LEVELING A REFRACTORY BED SURFACE

BACKGROUND OF THE INVENTION

1. Field of the Invention

The present invention relates to flattening a workpiece support surface comprised of loose granular material, and, more particularly, to a method and apparatus for spreading loose granular refractory material comprising a refractory bed contained in a transport car for a workpiece incident to heat treating in a furnace.

2. Description of the Prior Art

Heat treating furnaces are utilized in various stages of the production of metal products, and are utilized to perform treatments such as stress relieving, tempering, hardening, decarburizing, and annealing of metal workpieces particularly, coiled strip.

One type of heat treating furnace is a tunnel furnace as disclosed in U.S. Pat. No. 3,778,221, issued December 11, 1973. A coil of metal strip material or other workpiece to be treated is placed on a wheeled furnace car and carried thereby through the furnace which has the form of a long tunnel. The coil of metal strip is arranged with edge convolutions of the coil forming the load bearing surface for the coil. A sufficient number of furnace cars, each bearing a coil of metal strip, are inserted into the furnace in a sequential manner. As each furnace car enters the furnace, cars already residing therein are pushed further into the furnace. Once the furnace fills with these cars, each additional car inserted into the furnace results in a furnace car being pushed out of the furnace at the other end.

The tunnel furnace is typically operated at temperatures approaching two thousand degrees Fahrenheit. Because the furnace car and the coil of metal strip are heated, it was found that a steel base plate forming a carrier for the coil on the car underwent thermal distortions, causing damage to the edge of the coil supported by the base plate (such damage oftentimes descriptively referred to as "oil canning"). It has been discovered that the elimination of distortions to the steel floor plate did not avoid the same type of damage to the edge of the coil.

A refractory material is positioned on the load bearing floor of each furnace car. Sand has been used in the past, but a refractory material comprised of zirconia pebbles, referred to as a zirconia bubble bed, is now frequently employed.

When a bubble bed is used to support a coil of strip on the floor plate of the furnace car, if the refractory pebbles form an uneven coil support area, the bottom edge of the coiled strip is damaged. Prior to the placement of the coil on the refractory bubble bed, attempts are made to ensure that the refractory bed surface is flat. Presently, the refractory bubble bed is flattened and leveled visually by operating personnel using a hand-held push broom. A completely flat and level refractory bed surface is rarely obtained in this manner.

It is therefore the object of the present invention to provide an apparatus and method for flattening and/or leveling a bed surface of granular material used to support a workpiece for processing such as a heat treating operation.

SUMMARY OF THE PRESENT INVENTION

In accordance with one aspect of the present invention, the apparatus for flattening a surface of a refractory bed comprised of refractory pebbles includes template means having a flat face surface for redistributing the granular material of the refractory bed, and a plurality of tooth members projecting from the flat face surface to displace the granular material upon movement of the template means.

A plurality of tooth members are preferably arranged to extend from the flat face surface of the template to facilitate redistribution of the refractory pebbles for flattening a workpiece support area of the bed. A device, such as a bull's eye level, is preferably mounted on the template to reveal a desired degree of levelness of the flattened bed surface.

In another aspect of the present invention, there is provided a method for flattening a workpiece support area of a refractory bed comprised of refractory pebbles, the method including the steps of: placing a flat face surface of a template upon the refractory bed, and moving the template in a generally circular path to shift refractory pebbles contacting the flat face surface such that the surface of the refractory bed conforms to the flat surface of the template.

BRIEF DESCRIPTION OF THE DRAWINGS

The present invention will be better understood when the following description is read in light of the accompanying drawings in which.

DESCRIPTION OF THE PREFERRED EMBODIMENTS

Figure 1:
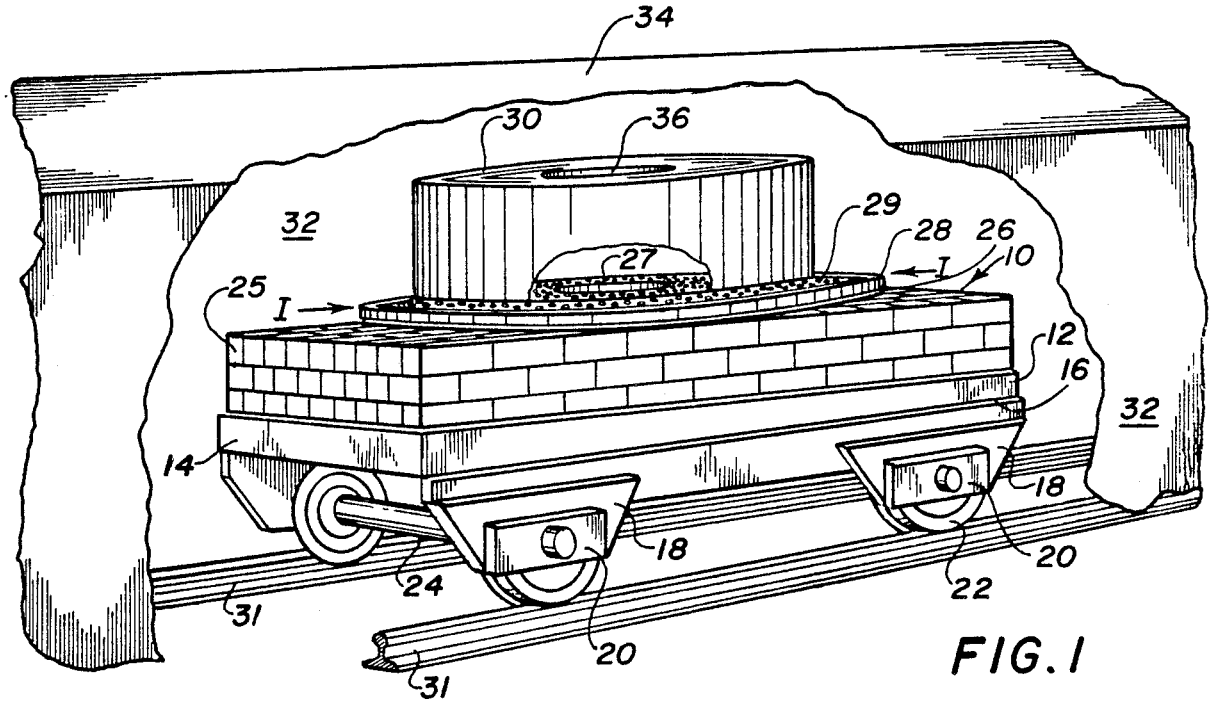
FIG. 1 is a perspective illustration of a tunnel furnace car having a refractory bed surface comprised of refractory pebbles which are operated on by the method and apparatus of the present invention.

In FIG. 1 there is illustrated a tunnel furnace car 10 which includes a car body with rectangularly arranged side walls 12 and end walls 14 upstanding about the outer periphery of a floor wall 16. Extending downwardly from the floor wall at the four corners thereof are frame sections 18 each of which carries bearing block 20. Wheels 22 are mounted at opposite ends of two axles 24 which are in turn supported by the bearing blocks 20.

Figure 1A:
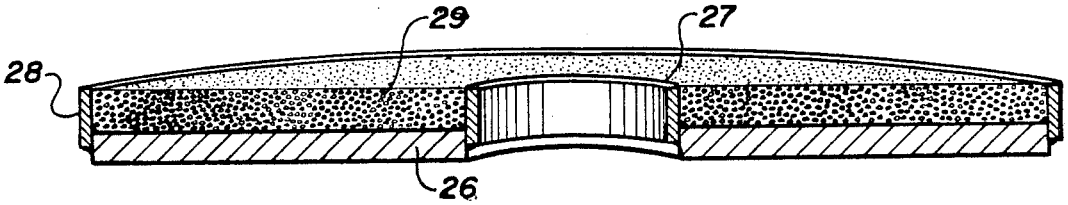
FIG. 1A is a sectional view of the refractory bed of the tunnel furnace car taken along line I—I of FIG. 1.

Refractory bricks 25 are supported upon the floor wall 16. Circular steel base plate 26 having inner and outer upstanding circular peripheral walls 27 and 28 is supported upon a top surface formed by the refractory bricks 25. A layer of loose granular refractory material 29 is placed in the bounded area formed by plate 26 and walls 27 and 28. One well known form of such refractory material consists of zirconia refractory pebbles. The bed formed thereby is commonly referred to as a bubble bed. Positioning of the refractory material is also shown in the sectional view of FIG. 1A. The material to be treated, here shown as a coil 30 of strip material, is supported upon the surface of the refractory bubble bed. The car moves along a pair of spaced-apart rails 31 on a furnace floor enclosed within side walls 32 and roof 34 of a tunnel furnace.

The coil 30 of strip material, as can be seen in FIG. 1, is deposited with the eye 36 of the coil extending vertically. The eye, as is well known, is formed by the mandrel on which the strip material is coiled. Thus it can be seen that the weight of the coil is supported by the edge surfaces of that one side of the convolutions of coiled strip material. The coil may be covered with a "skirt" which is a cylindrical metal body opened at one end only as is known. The covering acts to protect the outer wraps of the coil from overheating the tunnel furnace due to the radiant heat.

Once the coil is suitably positioned on the bubble bed in the furnace car 10, the car 10 is moved into a tunnel furnace whereat the car 10 and coil 30 of strip contained therein are heated to effect annealing and other heat treating operations of the coil. Refractory material upon which the coil rests minimizes temperature gradients which may damage the metal strip. However, as mentioned previously, if the top surface of the bed of refractory material is not flat or level, the resultant temperature gradients and/or non-uniform distribution of weight of the coil may cause damage to the metal strip, such as "oil canning".

Figure 2:
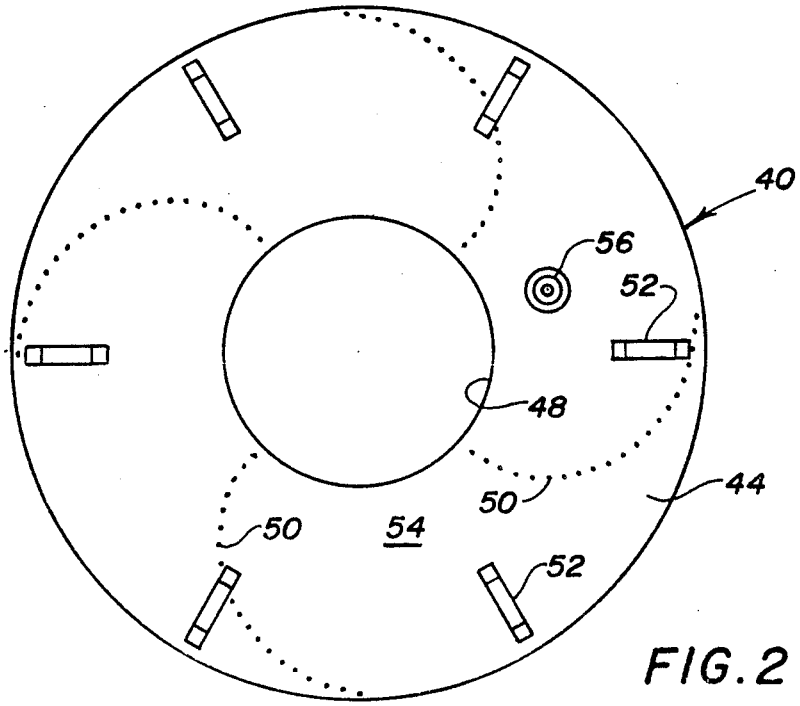
FIG. 2 is a plan view of the apparatus of the present invention.
Figure 3:
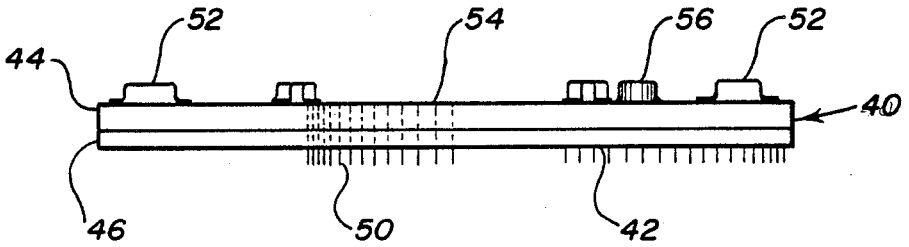
FIG. 3 is an elevational view of the apparatus shown in of FIG. 2.
Figure 4:
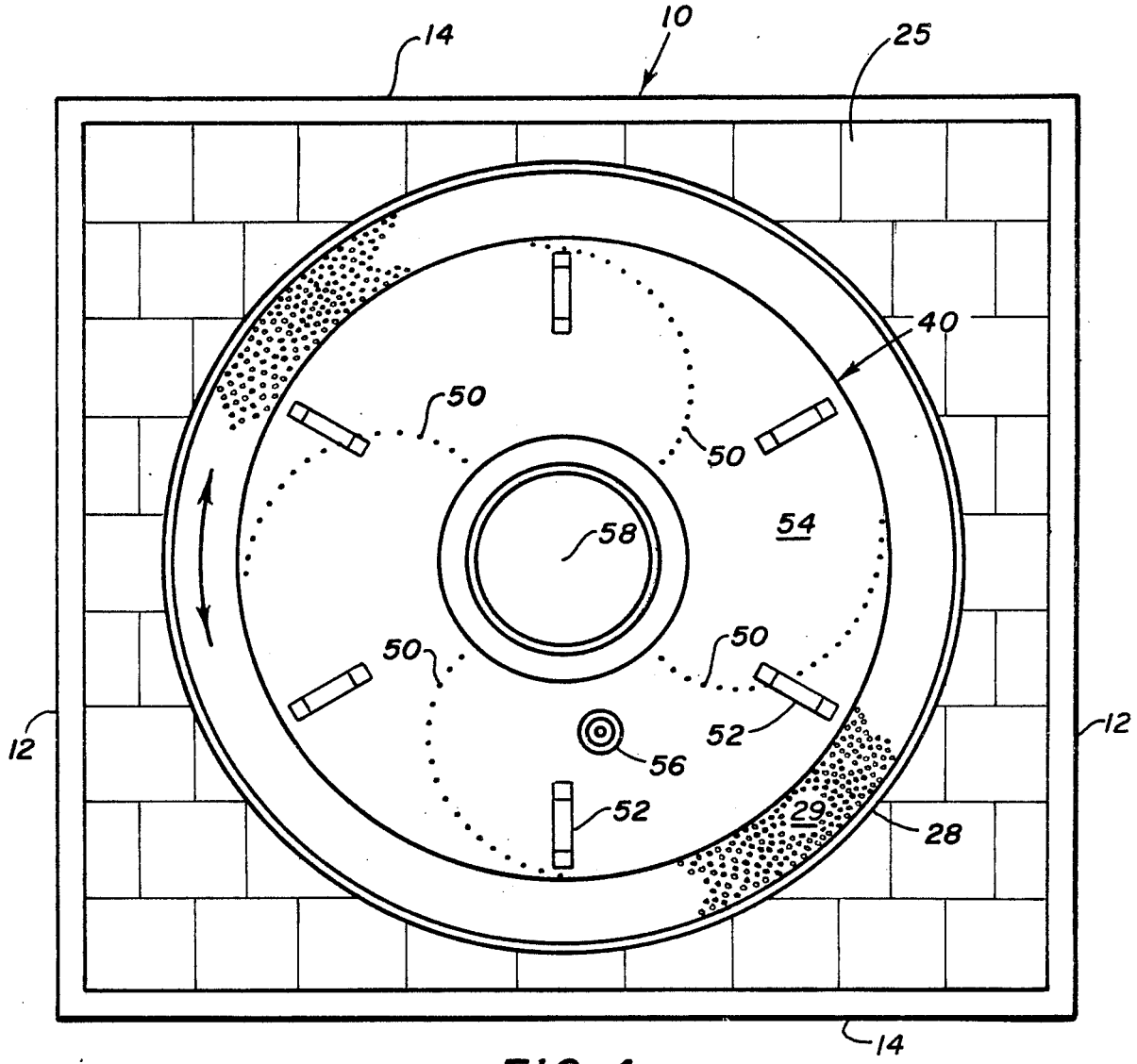
FIG. 4 is a plan view of the tunnel furnace car of FIG. 1 in which the apparatus of the present invention has been positioned upon a refractory bubble bed.

Referring now to FIGS. 2–4, there is illustrated the apparatus of the present invention to flatten and level the load bearing surface of the bubble bed, use of which alleviates the above-described damage to the metal coil. The apparatus includes template 40 having a flat face surface 42. In the illustrated embodiment, the template is comprised of an assembly of two disk-shaped plates formed of plates 44 and 46 of wood material, such as plywood superimposed one upon the other. Other material of construction may be utilized. Layer 44 forms a base to which layer 46, a relatively thin layer, is secured for support thereby. This construction facilitates the establishment of face surface 42 with the desired flatness. Because the eye 36 of the coil 30 of strip is hollow, the template may contain central aperture 48 corresponding to the diameter of the eye to reduce the weight of the template and also the manual effort required by workmen to carryout flattening and leveling operations.

A plurality of tooth members 50 are supported by the template 40 to project from the flat face surface 42 a short distance, e.g., approximately one half of an inch. Tooth members 50 are arranged at closely spaced apart intervals, as can be seen from FIG. 2, and, preferably, are arranged to form four helical arrangements of tooth members extending about the geometrical center of the disks forming the template. The tooth members may be comprised of nails driven through the plywood material of layers 44 and 46.

As shown in FIGS. 2 and 3, six handles 52 are mounted at spaced apart locations to a face surface 54 of the template which is opposite to surface 42. The template is preferably uniformly thick so that surfaces 42 and 54 are parallel. This allows measuring apparatus 56 to be positioned upon the upper surface 54 to provide a visual measure of any difference in altitude level of the granular material underlying the template. Measuring apparatus 56 may comprise a multi-planar level, such as a "bulls-eye" level.

Referring now to FIG. 4, there is illustrated the apparatus of the present invention positioned to rest upon the upper surface of refractory material comprising the bubble bed on the tunnel furnace car. Workmen grasp the handles 52 and carry the template 40 to a position where it is lowered onto the refractory bed. Once positioned to rest upon the top of refractory material, the workmen apply rotary torque to the template to flatten the surface of the refractory material by rotation about a vertical rotational axis 58 corresponding to the geometrical center of the disks. As the template is rotated to redress the surface of the refractory material, the tooth members 50 are caused to engage with the individual elements of the refractory bubble bed in a rake-like manner, causing the surface of the refractory material to conform with the flat bottom surface 42.

The operators then determine whether the flat surface of the refractory material is level by viewing measuring apparatus 56. If, after a revolution of the template, measuring apparatus 56 indicates that the surface of refractory material is not yet level, the operators repeat the process of rotating the template while modifying the pressure applied to the bed surface at a selected segment or segments of the template until measuring apparatus 56 indicates that the refractory surface is level.

Once the surface of the refractory material 29 has been redressed, the furnace operators then remove template 40 from the tunnel furnace car, and a coil of strip (or other metal stock) is positioned upon the flat and level surface of refractory material 29. The tunnel car 10 may be inserted into the furnace for heat treatment operations.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment but rather construed in breadth and scope in accordance with the recitation of the appended claims.

What is claimed is:

1. In combination, a refractory bed including granular refractory material contained within walls forming a generally circular bounded area and apparatus for spreading said granular refractory material within said generally circular bounded area of said refractory bed for providing uniform support of a workpiece positionable upon an upper surface of said granular material, said apparatus comprising:

template means having a flat face surface for redistributing the granular material of said refractory bed and further having a generally circular bounded area corresponding substantially in size and shape to said bounded area of said refractory bed, said template means substantially covering said bounded area of said refractory bed when placed thereupon causing, when moved about said upper surface of said granular material, flat and uniform distribution of said granular material at said upper surface thereof; and means for transferring force in a manner to produce movement of said template means about said upper surface of the granular refractory material to establish a flat and uniform workpiece support surface comprised of said granular refractory material.

2. The apparatus of claim 1 wherein said template means includes a plurality of tooth members projecting from said flat face surface to displace said granular material upon movement of the template means.

3. The apparatus of claim 1 wherein said template means further is formed with a center aperture corresponding to the eye of a coil of strip comprising said workpiece.

4. The apparatus of claim 2 wherein said plurality of tooth members are positioned to form a series of helical patterns.

5. The apparatus of claim 1 wherein said means for transferring force includes handle means mounted upon said template means at spaced locations thereabout for allowing an operator to grasp the handle means to provide a rotational torque to the template.

6. The apparatus of claim 1 further including means for visually displaying a measure of the levelness of the surface of the refractory bed.

7. The apparatus of claim 1 wherein said template means includes disk-shaped plates.

8. The leveling apparatus of claim 1 wherein said template means includes superimposed disk-shaped plates.

9. The leveling apparatus of claim 8 further including a bulls-eye level secured to said template means.

10. Apparatus for flattening and leveling a support surface of refractory pebbles forming a refractory bed upon a floor portion of a tunnel furnace car for supporting a coil of strip, said apparatus including:

disk means having a flat face surface suitable for establishing a flat coil support site on the refractory bed;

a plurality of tooth members carried by said disk means to project from said flat face surface for moving refractory pebbles about the refractory bed, said plurality of tooth members being arranged in a series of helical patterns about a central axis corresponding to a geometrical center of said disk means;

means mounted upon a surface of the disk means opposite said flat face surface for rotating said disk means about a circular path having a vertical axis generally corresponding to said geometrical center to cause the plurality of tooth members to engage with individual ones of the refractory pebbles in a manner to thereby redistribute the pebbles of the refractory bed and cause the refractory pebbles to conform to the flat bottom surface of the disk means; and means supported by said disk means for visually displaying a measure of the levelness of the refractory bed surface established by operation of said disk means for supporting a coil of strip material.

* * * * *